United States Patent [19]

Jacob

[11] Patent Number: 4,896,453

[45] Date of Patent: Jan. 30, 1990

[54] GROWTH-PREVENTING WEB FOR GROUND COVERING

[75] Inventor: Christian Jacob, Strasbourg, France

[73] Assignee: Sotralentz S.A., Drulingen, France

[21] Appl. No.: 232,608

[22] Filed: Aug. 15, 1988

[30] Foreign Application Priority Data

Aug. 17, 1987 [FR] France ..... 87 11703

[51] Int. Cl.[4] ..... A01G 7/00

[52] U.S. Cl. ..... 47/9; 47/32

[58] Field of Search ..... 47/9, 26–29, 47/32; 350/105; 428/141, 143, 195

[56] References Cited

U.S. PATENT DOCUMENTS

| | | | |
|---|---|---|---|
| 2,218,909 | 10/1940 | Gill | 350/105 |
| 2,294,930 | 9/1942 | Palmquist | 350/105 |
| 3,427,194 | 2/1969 | Lippoldt | 47/9 |
| 3,555,728 | 1/1971 | Herns | 47/9 |
| 4,154,637 | 5/1979 | Kasten | 47/9 X |

*Primary Examiner*—Robert A. Hafer
*Assistant Examiner*—Lynda M. Cofsky
*Attorney, Agent, or Firm*—Herbert Dubno

[57] ABSTRACT

A strip of vegetation-growth-blocking material for use as a ground cover as a polyethylene foil on an upper surface of which a bituminous protective and adhesive layer is applied to block ultraviolet deterioration of the foil. Gravel or a like heavy bulk material is bonded by the adhesive to the foil and a reflective layer can be applied to the gravel layer.

11 Claims, 1 Drawing Sheet

GROWTH-PREVENTING WEB FOR GROUND COVERING

FIELD OF THE INVENTION

My present invention relates to a ground covering, such as a mulch, adapted to prevent the growth of vegetation in the covered region.

BACKGROUND OF THE INVENTION

It is known to provide synthetic resin foil webs, i.e., so-called plastic mulches, for use as a ground covering in regions in which vegetation growth is to be prevented or limited. For example, desired plants may be grown through holes which then serve primarily to prevent the growth of weeds from detracting from the desired plant growth.

Such mulches and ground covers are also provided beneath decks or other structures in regions which are to be maintained free from vegetation and along landscape areas in which the growth of vegetation is to be prevented permanently or for a limited period of time to enhance a landscaping effect for example.

Such mulches have been used for many years for this purpose and generally consist of a black plastic, e.g. a polyurethane or preferably high density polyethylene.

Synthetic resin foils for this purpose can have a thickness of 80 micrometers or more and a web width of, say, 1 meter.

A particularly advantageous use of such growth-preventing strips is along highways and roadways, for example, below median barriers and elsewhere where vegetation growth is undesired.

The barriers can be supported on posts at intervals of 4 meters, for example, and the strips must clear such posts.

Because the synthetic resin foils which have been used tend to be picked up by the wind and displaced, it has been a common practice to weight the strips down by stones or the like which may be randomly placed on the strips.

Not withstanding the fact that this approach can generally serve to hold the strips in place, existing plastic mulches and growth-preventing plastic strips have the drawback that with time the foil deteriorates by the effect of sunlight and especially the ultraviolet component of sunlight.

Furthermore, the wind, especially a strong wind, can act upon the foil strip between the individual stones which serve to hold the strip in place and in combination with the weakening of the foil by ultraviolet light, the wind can damage the foil, i.e. can tear the foil so that the antivegetation effect will be lost.

The ultraviolet effect on the foil appears to be an accelerated oxidation of the polymer which results in a rupture of the molecular chains. With such deterioration of the foil, of course, the antivegetation effect can be lost even if there is little or no wind damage.

By and large, therefore, such plastic strips for preventing the growth of vegetation have proved incapable of tolerating long periods of exposure to sunlight, high winds or a combination of the two and have had in the past a relatively short useful life.

OBJECTS OF THE INVENTION

It is the principal object of the present invention to provide an improved vegetation growth-preventing web, generally in the form of a strip, which will avoid the drawbacks outlined above.

Another object of this invention is to provide a plastic mulch or like strip preventing the growth of vegetation or limiting such growth when applied to the ground and which will be more capable of withstanding the sun's rays for longer periods than earlier plastic mulches, which does not suffer from displacement by the wind and, nevertheless, is of relatively low cost and can be of an esthetic appearance.

SUMMARY OF THE INVENTION

These objects and others which will become apparent hereinafter are attained, in accordance with the invention, by applying to an upper surface of a conventional mulch foil, generally of polyurethane or polyethylene, a bituminous protective layer which serves to protect the underlying foil against sunlight. This bituminous layer also serves as an adhesive or bonding layer by means of which a weighting layer of a bulk material of high specific gravity, preferably gravel, can be fixed to the synthetic resin foil.

It is known from German Open Patent DE-OS No. 35 15 144 to provide ground coverings which are composed of a plurality of layers and in which the uppermost layer is a heavy bulk material for weighting the foil against entrainment by the wind.

In this case, however, the bulk material is not bonded by a bitumen which can serve both as an adhesive and as a protective layer to a conventional plastic mulch foil.

In this prior art system, the lowest layer is not a foil but rather is a paper which must be impregnated with a herbicide, is subjected to weathering and within two seasons permits grass to grow therethrough. With the system of the invention, however, growth is prevented practically permanently until the plastic mulch is removed since light and air are both excluded from the covered region.

The invention thus comprises:

a synthetic-resin foil layer of polyurethane or polyethylene having an upper surface;

a bituminous protective layer covering the upper surface and protecting the synthetic-resin foil layer against degradation by sunlight while forming an adhesive; and a weighting layer of pieces of a relatively heavy bulk material on and substantially covering the upper surface and bonded by the bituminous layer to the foil for holding the web on the ground and preventing wind-lifting thereof.

The invention is based upon my discovery that the bituminous protective layer can serve a number of functions. Primarily, it provides an effective protection of the synthetic resin foil against sunlight. Surprisingly, this layer is especially effective against ultraviolet radiation, contributes to the weighting of the foil and forms a permanent binder between the bulk material and the foil.

The vegetation-growth barrier of the invention, because of the presence of the synthetic resin foil, is water impermeable.

The protective bitumen layer can contain or be composed of road-surfacing bitumen which is also used widely as a binder in road surfacing or road construction. In the present invention, however, the bitumen serves not only as an adhesive for the gravel but also as a protective layer because its black color and practically opaque nature prevents the ultraviolet rays in sunlight from reaching the synthetic resin foil. In this case, one can make use of the excellent light absorption qualities of the bitumen layer.

When the vegetation-barrier strips are to be laid in forested or wilderness areas, it has been found to be advantageous to add to the bitumen layer and preferably also in the fabrication of the synthetic resin foil, a fire retardent substance.

To improve the adhesive properties and flexibility of the bitumen layer, bitumen can be joined with one or more elastomers.

When the bitumen is applied alone or in combination with the elastomer, it is preferably applied in the form of an emulsion which can be coated onto the synthetic resin foil by any conventional coating techniques.

The layer thickness can correspond to an application of the bituminous layer in an amount of 0.4 kg/m$^2$.

The weighting layer is preferably a crushed stone or gravel which is applied in an amount of 5 kg/m$^2$ and can have a grain size ranging between about 2 mm and 5 cm, preferably up to several cm.

When the gravel is applied in a fairly dense manner, it can provide additional protection of the mulch against weathering.

Furthermore, the weighting layer not only prevents uplifting of the foil by the width, but also floating of the foil away when the ground to which the mulch is applied is flooded or washed heavily with water.

It has been found to be advantageous, moreover, to cover the weighting layer with a coloring layer and to protect the covering layer by a layer of glass beads preferably glass beads having a diameter of about 1 mm.

The glass beads should be provided in at least two layers in a close packed or other densely packed organization.

The result is additional protection against lifting by the wind, but more significantly, the imparting of light reflectivity and color to the strip to improve its esthetic appearance and render the strip light reflective. This is of particular importance by median coverings since the median will then be visible in the headlights of oncoming vehicles.

It is especially advantageous, moreover, to provide the strips so that they have overlapping seams along longitudinal edges which can be formed with additional bonding recesses or cutouts. The overlapping seams can have the undersides of the foils folded over one another or turned over on one another to form edge reinforcements. Transverse folds can be provided in the foil of the ground covering of the invention as well.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 2:
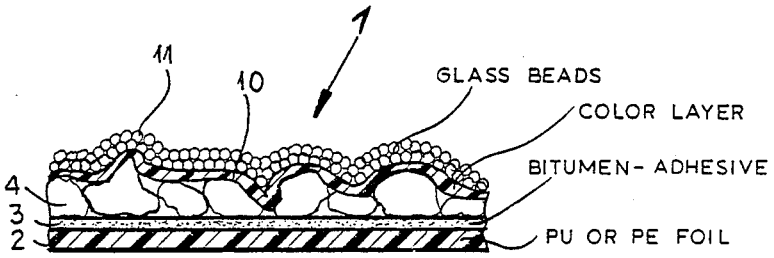
FIG. 2 is a cross sectional view illustrating another embodiment of the ground covering and drawn to a larger scale.
Figure 1:
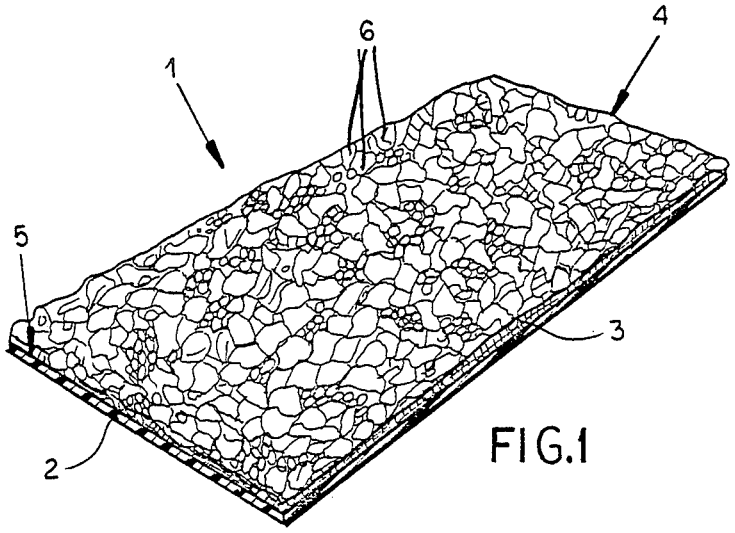
FIG. 1 is a perspective view of a ground covering according to the invention.

As can be seen from the drawing, a ground covering capable of preventing or limiting vegetation growth and represented at 1 can comprise on the upper surface 5 of the polyurethane or polyethylene foil 2, a bituminous layer 3 which protects the soil against sunlight and especially the ultraviolet radiation of sunlight.

The protective layer 3 also forms a binder or adhesive layer which retains the layer 4 of a bulk granular material 6 of high specific weight onto the synthetic resin foil 2. The layer 4 can be composed of gravel.

The binder layer 3 is composed of road-surfacing bitumen or a mixture thereof with an elastomer and can be applied in the form of a latex by any conventional application means suitable for coating with emulsions. The granular layer 4 is applied in a layer of a thickness corresponding to 5 kg/m$^2$ and can be composed of particles with a grain size between 2 mm and several cm.

Figure 3:
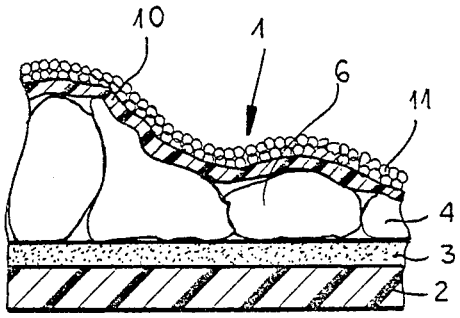
FIG. 3 is a cross sectional further enlargement of FIG. 2.

As can be seen from FIGS. 2 and 3, moreover to the gravel layer can be applied a color layer 10 of a colored translucent synthetic resin, e.g. a colored polyurethane lacquer to which is applied, before it sets, densely packed glass beads 11 having a diameter of about 1 mm. The glass beads provide excellent reflectivity when the strip is used to prevent vegetation growth beneath a median barrier of a highway median.

We claim:

1. A vegetation-growth-preventing web, comprising:

a synthetic-resin foil layer of polyurethane or polyethylene having an upper surface;

a bituminous protective layer covering said upper surface and protecting said synthetic-resin foil layer against degradation by sunlight while forming an adhesive; and a weighting layer of pieces of a relatively heavy bulk material on and substantially covering said upper surface in an amount of 5 kg/m$^2$ and bonded by said bituminous layer to said foil for holding said web on the ground and preventing wind-lifting thereof;

a coloring layer on said weighting layer of pieces of relatively heavy bulk material, and a covering of glass beads on said coloring layer.

2. The vegetation-growth-preventing web defined in claim 1 wherein said bituminous protective layer is composed of road-surfacing bitumen.

3. The vegetation-growth-preventing web defined in claim 1 wherein said bituminous protective layer is composed of a composition containing road-surfacing bitumen and at least one elastomer.

4. The vegetation-growth-preventing web defined in claim 2 wherein said weighting layer of pieces of relatively heavy bulk material is composed of a stony granulate.

5. The vegetation-growth-preventing web defined in claim 4 wherein said stony granulate is a gravel.

6. The vegetation-growth-preventing web defined in claim 4 wherein said granulate has particles of a particle size between two millimeters and five centimeters.

7. The vegetation-growth-preventing web defined in claim 6 wherein said glass beads are provided in at least two layers in a dense packed orientation.

8. The vegetation-growth-preventing web defined in claim 1 wherein said weighting layer of pieces of relatively heavy bulk material is composed of a stony granulate.

9. The vegetation-growth-preventing web defined in claim 11 wherein said stony granulate is a gravel.

10. The vegetation-growth-preventing web defined in claim 8 wherein said granulate has particles of a particle size between two millimeters and five centimeters.

11. The vegetation-growth-preventing web defined in claim 1 wherein said glass beads are provided in at least two layers in a dense packed orientation.

* * * * *